US009644628B2

(12) United States Patent
Yamashita et al.

(10) Patent No.: US 9,644,628 B2
(45) Date of Patent: May 9, 2017

(54) MOTOR-DRIVEN COMPRESSOR HAVING OIL PASSAGE THAT FACILITATES BEARING LUBRICATION

(71) Applicant: KABUSHIKI KAISHA TOYOTA JIDOSHOKKI, Kariya-shi, Aichi-ken (JP)

(72) Inventors: Takuro Yamashita, Kariya (JP); Ken Suitou, Kariya (JP); Hiroyuki Gennami, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 428 days.

(21) Appl. No.: 13/650,903

(22) Filed: Oct. 12, 2012

(65) Prior Publication Data

US 2013/0094987 A1 Apr. 18, 2013

(30) Foreign Application Priority Data

Oct. 17, 2011 (JP) ..... 2011-228150
Oct. 4, 2012 (JP) ..... 2012-222283

(51) Int. Cl.
*F04C 18/02* (2006.01)
*F04C 29/02* (2006.01)
*F04C 23/00* (2006.01)

(52) U.S. Cl.
CPC ..... *F04C 18/0215* (2013.01); *F04C 23/008* (2013.01); *F04C 29/023* (2013.01)

(58) Field of Classification Search
CPC ... F04C 18/0215; F04C 23/008; F04C 29/023
(Continued)

(56) References Cited

U.S. PATENT DOCUMENTS 4,818,198 A * 4/1989 Tamura et al. ..... 418/55.6
4,917,582 A 4/1990 Fraser, Jr. et al.
(Continued)

FOREIGN PATENT DOCUMENTS

FR 2919688 A1 2/2009
JP 5815787 A 1/1983
(Continued)

OTHER PUBLICATIONS

English Machine Translation of JP 11-351175 A (translated on Nov. 3, 2014).*
(Continued)

*Primary Examiner* — Nicholas J Weiss
*Assistant Examiner* — Paul Thiede
(74) *Attorney, Agent, or Firm* — Sughrue Mion, PLLC

(57) ABSTRACT

A motor-driven compressor includes a compression mechanism. The compression mechanism includes a stationary scroll and a movable scroll. The movable scroll and the stationary scroll form a compression chamber. The motor-driven compressor has an electric motor accommodated in a motor chamber, a suction pressure zone, a discharge chamber, and an oil passage, which is connected either to the compression chamber or the discharge chamber. The electric motor includes a rotary shaft and drives the movable scroll via the rotary shaft. A main bearing located in the vicinity of the compression mechanism rotationally supports the rotary shaft. The rotary shaft has an in-shaft passage. The oil passage has a radial passage, which is directly connected to the in-shaft passage, and the in-shaft passage has an outlet, which opens to the motor chamber. The main bearing is exposed in the oil passage. The motor chamber is the suction pressure zone.

7 Claims, 6 Drawing Sheets

(58) Field of Classification Search
USPC ..... 418/55.6; 417/321
See application file for complete search history.

(56) References Cited

U.S. PATENT DOCUMENTS

| | | | | |
|---|---|---|---|---|
| 4,997,350 | A * | 3/1991 | Tamura et al. | 418/55.6 |
| 5,013,225 | A | 5/1991 | Richardson, Jr. | |
| 6,158,980 | A | 12/2000 | Tsumagari et al. | |
| 6,196,817 | B1 * | 3/2001 | Tsumagari et al. | 418/55.6 |
| 6,599,110 | B2 * | 7/2003 | Gennami et al. | 418/55.6 |
| 2003/0098216 | A1 * | 5/2003 | Hayashi | F16D 41/066 192/48.92 |
| 2009/0041603 | A1 | 2/2009 | Ginies et al. | |
| 2009/0136372 | A1 * | 5/2009 | Elson et al. | 418/55.6 |
| 2009/0304539 | A1 | 12/2009 | Kii et al. | |
| 2010/0329915 | A1 | 12/2010 | Lee et al. | |

FOREIGN PATENT DOCUMENTS

| | | | |
|---|---|---|---|
| JP | 58-170871 | A | 10/1983 |
| JP | 05-044668 | A | 2/1993 |
| JP | 6-2682 | A | 1/1994 |
| JP | 11-351175 | A | 12/1999 |
| JP | 2004-225644 | A | 8/2004 |
| JP | 2006-177239 | A | 7/2006 |
| JP | 2008-138578 | A | 6/2008 |
| JP | 2008-184973 | A | 8/2008 |
| JP | 2010-014108 | A | 1/2010 |

OTHER PUBLICATIONS

English Machine Translation of JP H06-2682 A from Espacenet. Translation made on May 18, 2016.*

Communication dated Dec. 22, 2015 from the Japanese Patent Office in counterpart application No. 2012-222283.

* cited by examiner

MOTOR-DRIVEN COMPRESSOR HAVING OIL PASSAGE THAT FACILITATES BEARING LUBRICATION

BACKGROUND OF THE INVENTION

The present invention relates to a motor-driven compressor, and more specifically, a scroll type motor-driven compressor that drives a movable scroll by using an electric motor.

For example, Japanese Laid-Open Patent Publication No. 11-351175 discloses a scroll type motor-driven compressor that includes a movable scroll driven by an electric motor. The movable scroll receives drive force from the electric motor via a rotary shaft rotated by the electric motor. Lubrication of a main bearing, which rotationally support the rotary shaft, is important. The main bearing of the motor-driven compressor disclosed in the above publication is lubricated by supplying oil stored in a bottom portion of a motor chamber in a middle housing to the main bearing via an oil supply hole. In the motor-driven compressor, to supply oil stored in the bottom portion of the motor chamber via the oil supply hole, the motor chamber is exposed to discharge pressure, which is higher than suction pressure.

However, in a state in which the motor chamber is exposed to discharge pressure, the temperature of the motor chamber is relatively high. The temperature of the electric motor is increased, accordingly, which is not favorable for the motor performance.

SUMMARY OF THE INVENTION

Accordingly, it is an objective of the present invention to provide a scroll type motor-driven compressor that maintains favorable lubrication of the main shaft while preventing the motor chamber from being undesirably heated.

To achieve the foregoing objective and in accordance with one aspect of the present invention, a motor-driven compressor including a compression mechanism, which includes a stationary scroll, a movable scroll, which orbits without being allowed to rotate, and a compression chamber located between the movable scroll and the stationary, the volume of the compression chamber decreasing based on orbiting motion of the movable scroll. The motor-driven compressor includes an electric motor accommodated in a motor chamber. The electric motor includes a rotary shaft and drives the movable scroll via the rotary shaft. The motor-driven compressor includes a main bearing, which is located in the vicinity of the compression mechanism and rotationally supports the rotary shaft. The motor-driven compressor has a suction pressure zone, a discharge pressure zone, and an oil passage, which is connected either to the compression chamber or the discharge pressure zone. The rotary shaft has an in-shaft passage. The in-shaft passage has an inlet, which is directly connected to the oil passage, and an outlet, which opens to the motor chamber. The main bearing is exposed to the oil passage. The motor chamber is the suction pressure zone.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A scroll type motor-driven compressor 10 according to a first embodiment of the present invention will now be described with reference to FIGS. 1 to 3.

Figure 1:
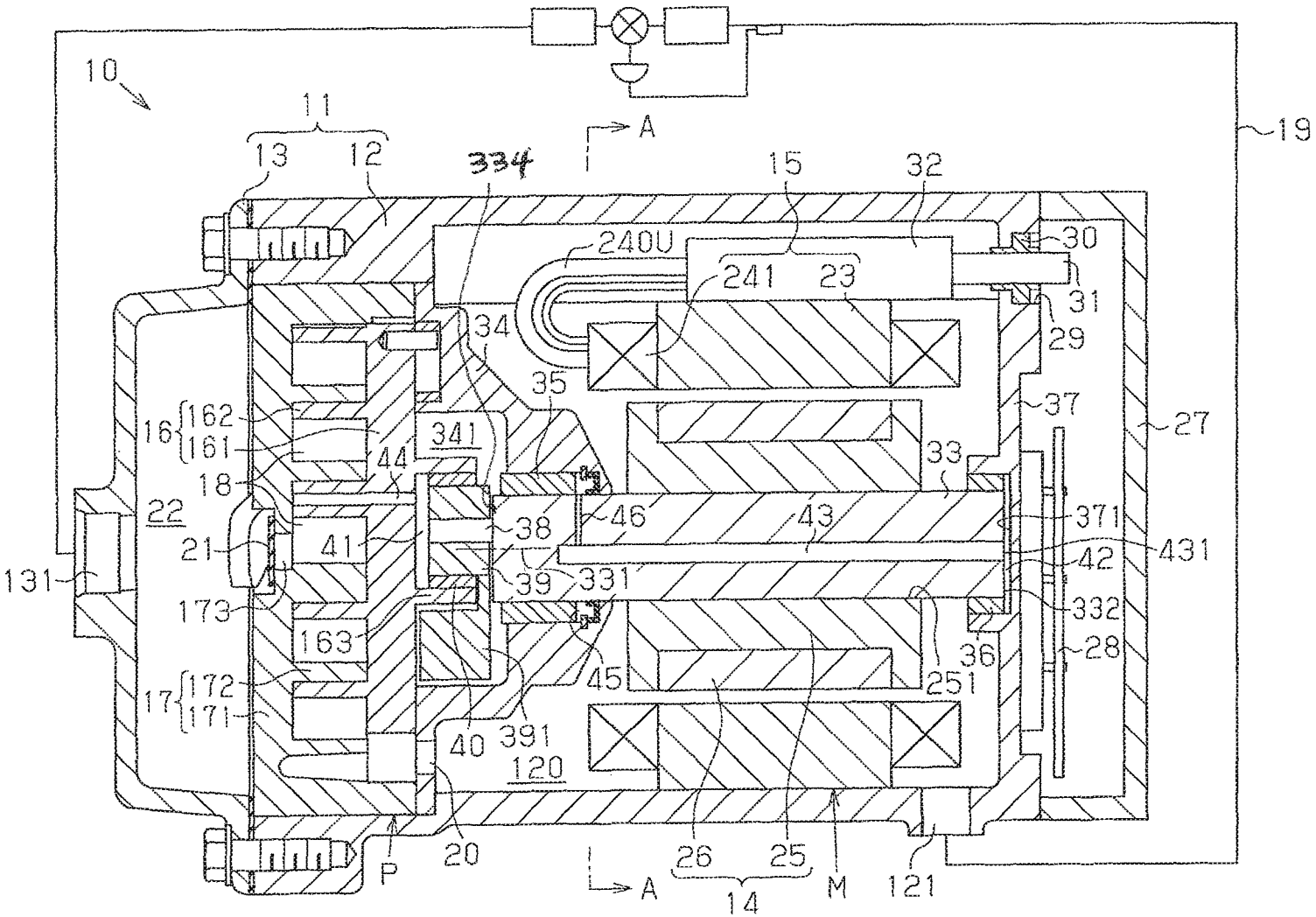
FIG. 1 is a cross-sectional side view showing a whole motor-driven compressor according to a first embodiment of the present invention.

As shown in FIG. 1, an outer shell 11 of the scroll type motor-driven compressor 10 is formed by a motor housing 12 and a front housing 13, which is coupled to the front end of the motor housing 12.

An electric motor M is accommodated in a motor chamber 120 of the motor housing 12. The electric motor M includes a rotor 14, which is fixed to a rotary shaft 33, and a stator 15, which is fitted and fixed to the inner circumferential surface of the motor housing 12.

In a front portion of the motor housing 12, a stationary block 34 and a stationary scroll 17 are fixed to face each other. A movable scroll 16 is accommodated between the stationary scroll 17 and the stationary block 34 to be allowed to orbit. The movable scroll 16 is formed by a base plate 161 and a volute wall 162, which extends from the base plate 161.

The stationary scroll 17 is formed by a base plate 171 and a volute wall 172, which extends from the base plate 171.

The electric motor M has the rotary shaft 33. The rotary shaft 33 is rotationally supported by the stationary block 34 via a main bearing 35, and is rotationally supported by a rear end wall 37 of the motor housing 12 via an auxiliary bearing 36. The main bearing 35 and the auxiliary bearing 36 are both slide bearings.

Figure 3B:
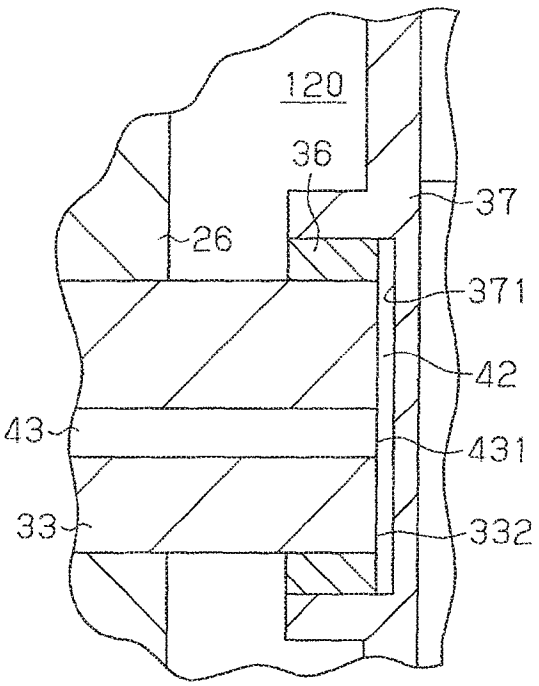
FIG. 3B is an enlarged cross-sectional side view showing the motor-driven compressor of FIG. 1.

As shown in FIG. 3B, a recess 371 is formed in the rear end wall 37, and the auxiliary bearing 36 is fitted in and fixed to the recess 371. A clearance 42 exists between a rear end face 332 of the rotary shaft 33 and the bottom of the recess 371.

As shown in FIG. 1, an eccentric shaft 38 protrudes from a front end face 334 of the rotary shaft 33, and a bushing 39 is fitted and fixed to the eccentric shaft 38. On the back face of the base plate 161 of the movable scroll 16, a cylindrical portion 163 is integrally formed with the movable scroll 16. A back pressure chamber 341 is formed in the front surface of the stationary block 34. The cylindrical portion 163 extends into the back pressure chamber 341, and an orbiting bearing 40 and the bushing 39 are fitted in the cylindrical portion 163. The orbiting bearing 40 is a slide bearing. The bushing 39 is rotational relative to the cylindrical portion 163. A clearance 41 exists between the back surface of the base plate 161 and the end face of the bushing 39. A balance weight 391 is integrally formed with the bushing 39.

When the rotary shaft 33 rotates, the bushing 39 is rotated eccentrically about an axis 331 of the rotary shaft 33. This causes the movable scroll 16 to orbit about the axis 331, so that compression chambers 18 between the movable scroll 16 and the stationary scroll 17 are moved radially inward while decreasing the volumes. The movable scroll 16 and the stationary scroll 17 constitute a compression mechanism P, which draws in and discharges refrigerant. At a position opposite to the main bearing 35 in the motor chamber 120, the rotary shaft 33 is rotationally supported by the auxiliary bearing 36. The main bearing 35 is located in the vicinity of the compression mechanism M.

An inlet port 121 is formed in the motor housing 12. The inlet port 121 is connected to an external refrigerant circuit 19, and refrigerant (gas) is conducted into the motor chamber 120 from the external refrigerant circuit 19 through the inlet port 121. Orbiting motion (suction motion) of the movable scroll 16 draws refrigerant that has been introduced into the motor chamber 120 into the compression chambers 18 through the space between the inner circumferential surface of the motor housing 12 and the outer circumferential surface of the stator 15, and a suction port 20. The refrigerant gas in each compression chamber 18 is compressed by orbiting motion of the movable scroll 16 (discharge operation), and is discharged into a discharge chamber 22 in the front housing 13 through a discharge port 173 while flexing a discharge valve flap 21. The refrigerant in the discharge chamber 22 flows out to the external refrigerant circuit 19 through a delivery port 131 formed in the front housing 13, and is recirculated to the motor chamber 120.

Figure 2:
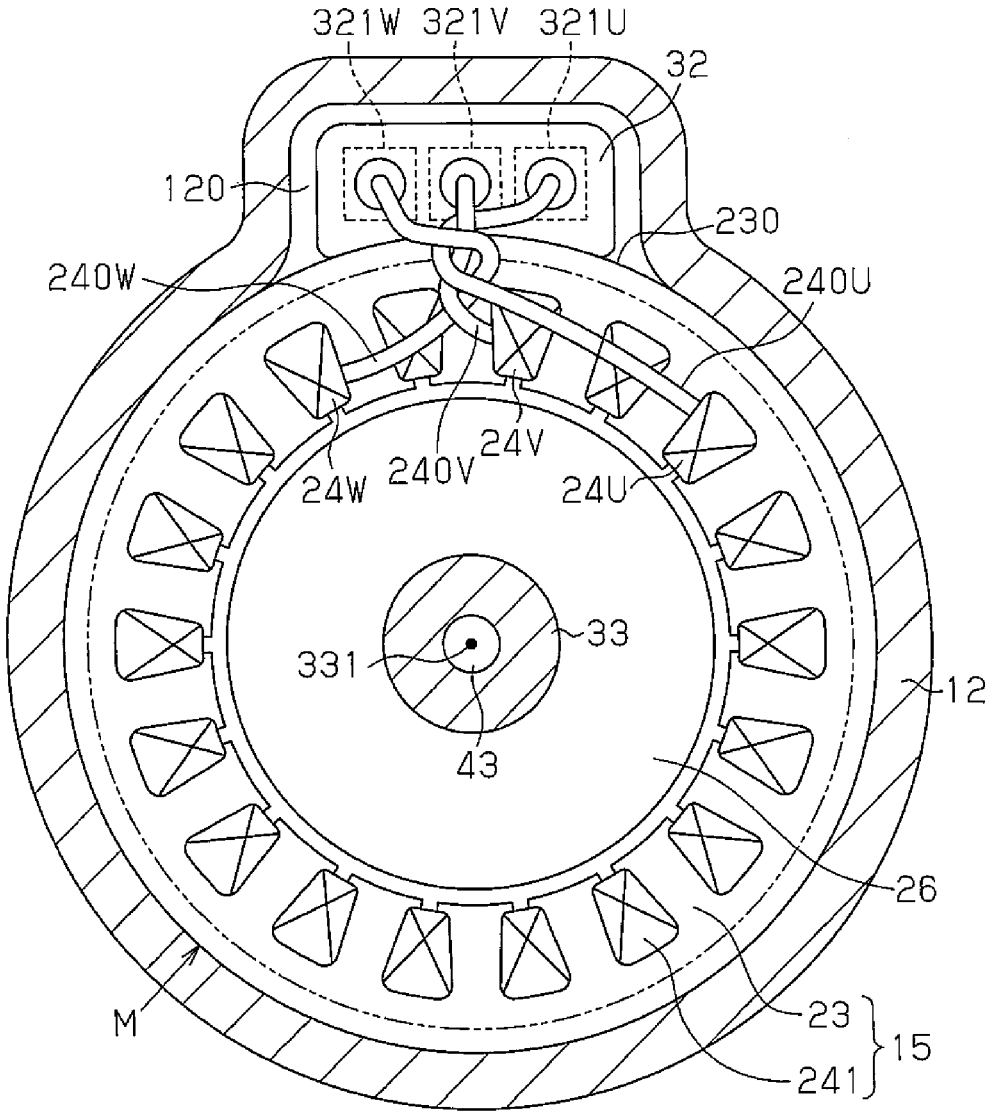
FIG. 2 is an enlarged cross-sectional view taken along line A-A of FIG. 1.

As shown in FIG. 2, the stator 15 of the electric motor M includes an annular stator core 23, and a U-phase coil 24U, a V-phase coil 24V, and a W-phase coil 24W, which are wound about the stator core 23. Lead wires 240U, 240V, and 240W of the U-phase coil 24U, the V-phase coil 24V, and the W-phase coil 24W extend from a front coil end 241.

As shown in FIG. 1, the rotor 14 of the electric motor M includes a rotor core 25 and permanent magnets 26, which are embedded in the rotor core 25. A shaft hole 251 extends through the center of the rotor core 25. The rotary shaft 33 is passed through the shaft hole 251 and fixed to the rotor core 25.

A cover 27 is secured to the rear end face of the motor housing 12. An inverter 28 is installed in the cover 27. An insertion hole 29 is formed in the end face of the motor housing 12, which is covered with the cover 27. A holding member 30 is fitted in and fixed to the insertion hole 29. Three conductive pins 31 (only one is shown) extend through and are held by the holding member 30. Outer ends of the conductive pins 31, which are protruding outside from the outer shell 11 (the motor housing 12), are connected to the inverter 28 via non-illustrated conductive wires.

As shown in FIG. 2, a cluster block 32 made of insulating plastic is secured to an outer circumferential surface 230 of the stator core 23. The cluster block 32 accommodates a plurality of (three) connectors 321U, 321V and 321W. The U-phase coil 24U, the V-phase coil 24V, and the W-phase coil 24W are electrically connected to the conductive pins 31 (see FIG. 1) in one-to-one correspondence via the connectors 321U, 321V, and 321W, respectively. When the inverter 28 supplies electricity to the coils 24U, 24V, 24W via the conductive pins 31, the connectors 321U, 321V, 321W, and the lead wires 240U, 240V, 240W, the rotor 14 and the rotary shaft 33 rotate integrally.

As shown in FIG. 1, the rotary shaft 33 has an in-shaft passage 43, which extends in the longitudinal direction of the rotary shaft 33. The in-shaft passage 43 has an outlet 431 located in the rear end face 332 of the rotary shaft 33. The clearance 42 communicates with the in-shaft passage 43.

Figure 3A:
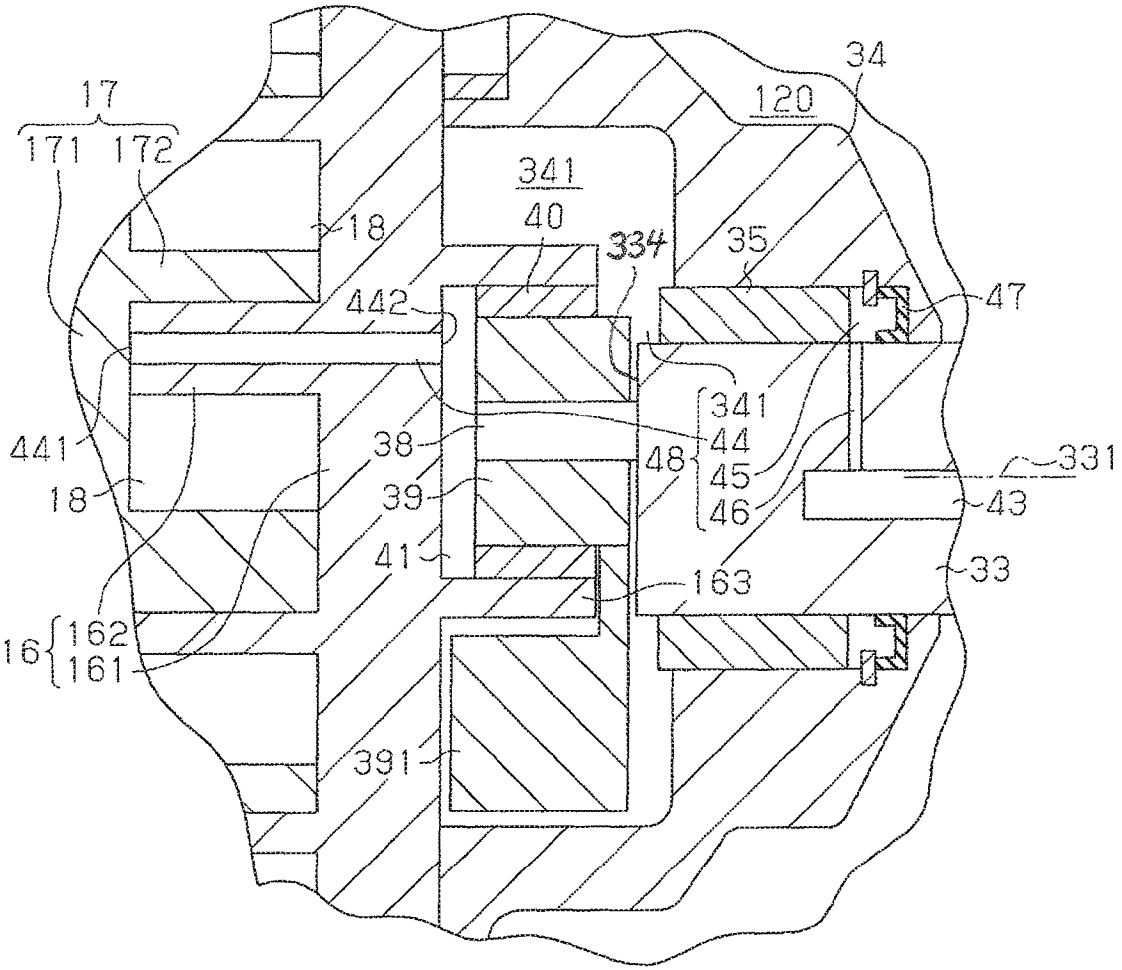
FIG. 3A is an enlarged cross-sectional side view partially showing the motor-driven compressor of FIG. 1.

As shown in FIG. 3A, the movable scroll 16 has a passage 44, which extends through the base plate 161 and a part of the volute wall 162 close to the center. An inlet 441 of the passage 44 opens in the front end face of the volute wall 162, and the passage 44 is connected to the compression chambers 18. An outlet 442 of the passage 44 opens in the back face of the base plate 161 in the cylindrical portion 163. The passage 44 communicates with the clearance 41.

The main bearing 35 is accommodated in an annular accommodation space 45, which communicates with the in-shaft passage 43 via a radial passage 46. The radial passage 46 functions as an inlet to the in-shaft passage 43 that opens in the accommodation space 45. A sealing member 47 is arranged in a rear portion of the accommodation space 45. The sealing member 47 prevents refrigerant from leaking along the circumferential surface of the rotary shaft 33 from the accommodation space 45 to the motor chamber 120.

Operation of the first embodiment will now be described.

The back pressure chamber 341 is exposed to the pressure in the compression chamber 18 closer to the center of the movable scroll 16 via the passage 44 and the clearance 41. When the back pressure is insufficient, for example, at the starting of operation, the force by which the distal end of the volute wall 162 of the movable scroll 16 is pressed against the volute wall 172 of the stationary scroll 17 is small. Thus, the distal end of the volute wall 162 of the movable scroll 16 and the volute wall 172 of the stationary scroll 17 separate from each other in some cases. In such a case, some of compressed refrigerant in the compression chambers 18 passes through the passage 44, the clearance 41, and the orbiting bearing 40, so that the orbiting bearing 40 is lubricated with lubricant oil contained in the refrigerant passing through the orbiting bearing 40. After passing through the orbiting bearing 40, the refrigerant passes through the main bearing 35 via the back pressure chamber 341, so that the main bearing 35 is lubricated with lubricant oil contained in the passing refrigerant.

The refrigerant that has passed through the main bearing 35 flows into the in-shaft passage 43 via the accommodation space 45 and the radial passage 46. The refrigerant that has flowed into the in-shaft passage 43 then passes through the auxiliary bearing 36 via the clearance 42. The auxiliary bearing 36 is lubricated with lubricant oil contained in the refrigerant passing through the auxiliary bearing 36. After passing through the auxiliary bearing 36, the refrigerant flows out to the motor chamber 120, which is a suction pressure zone. The structure, in which the auxiliary bearing 36 is formed by a slide bearing 36, is advantageous in reducing the space occupied by the auxiliary bearing 36 in the radial direction.

The passage 44, the clearance 41, the back pressure chamber 341, the accommodation space 45, and the radial passage 46 form an oil passage 48 from the compression chamber 18 to the in-shaft passage 43. The main bearing 35 is exposed in the oil passage 48. The radial passage 46, which functions as an inlet, communicates with the oil passage 48 to the in-shaft passage 43.

The first embodiment has the advantages described below.

(1) Some of the refrigerant in the compression chambers 18 flows out to the motor chamber 120 via the oil passage 48 and the in-shaft passage 43, so that lubricant oil contained in the refrigerant in the compression chambers 18 lubricates the main bearing 35. Since the motor chamber 120 is a suction pressure zone, the pressure of which is lower than that in the compression chambers 18, lubricant oil contained in the refrigerant in the compression chambers 18 smoothly flows through the oil passage 48 and the in-shaft passage 43 to readily lubricate the main bearing 35 and the auxiliary bearing 36.

(2) The temperature of refrigerant that is returned from the external refrigerant circuit 19 to the motor chamber 120 is low. This prevents the temperature of the electric motor M, which is accommodated in the motor chamber 120, from being increased.

(3) Since the main bearing 35 is a slide bearing, the space occupied by the main bearing 35 is relatively small in the radial direction, and thus the size of the stationary block 34 can be reduced. This is advantageous in reducing the weight of the stationary block 34.

Hereinafter, motor-driven compressors according to second to fourth embodiments will be described. The same reference numerals are given to those components that are the same as the corresponding components of the first embodiment, and detailed explanations are omitted.

Figure 4:
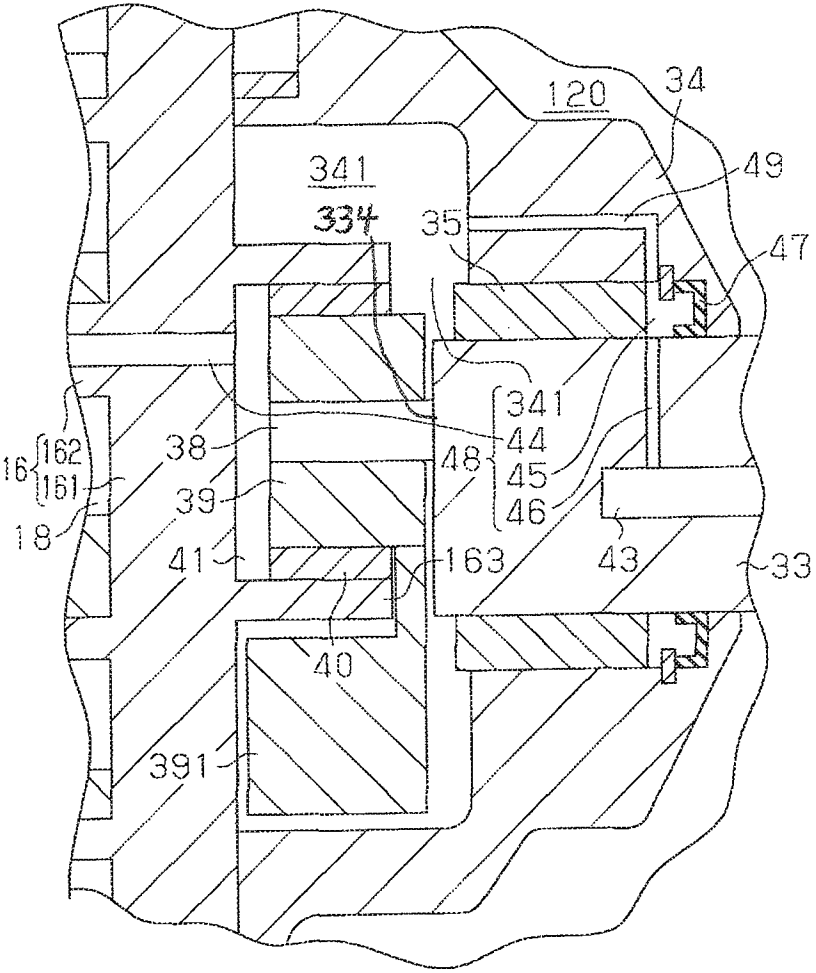
FIG. 4 is an enlarged cross-sectional side view partially showing a motor-driven compressor according to a second embodiment of the present invention.

A motor-driven compressor according to a second embodiment will now be described with reference to FIG. 4.

An auxiliary passage 49 is formed in the stationary block 34. The auxiliary passage 49 branches from the oil passage 48 and bypasses the main bearing 35. The auxiliary passage 49 is located at a position higher than the main bearing 35. Lubricant oil contained in refrigerant that has passed through the orbiting bearing 40 and flowed out to the back pressure chamber 341 is likely to be separated and drop downward. Therefore, the amount of lubricant contained in the refrigerant that enters the auxiliary passage 49 is small, and lubricant contained in the refrigerant in the back pressure chamber 341 mainly flows along the surface of the main bearing 35. That is, the auxiliary passage 49 contributes to smooth flow refrigerant from the oil passage 48 to the in-shaft passage 43, and slows down the flow of lubricant oil lubricating the main bearing 35, thereby contributing favorable lubrication of the main bearing 35.

Figure 5:
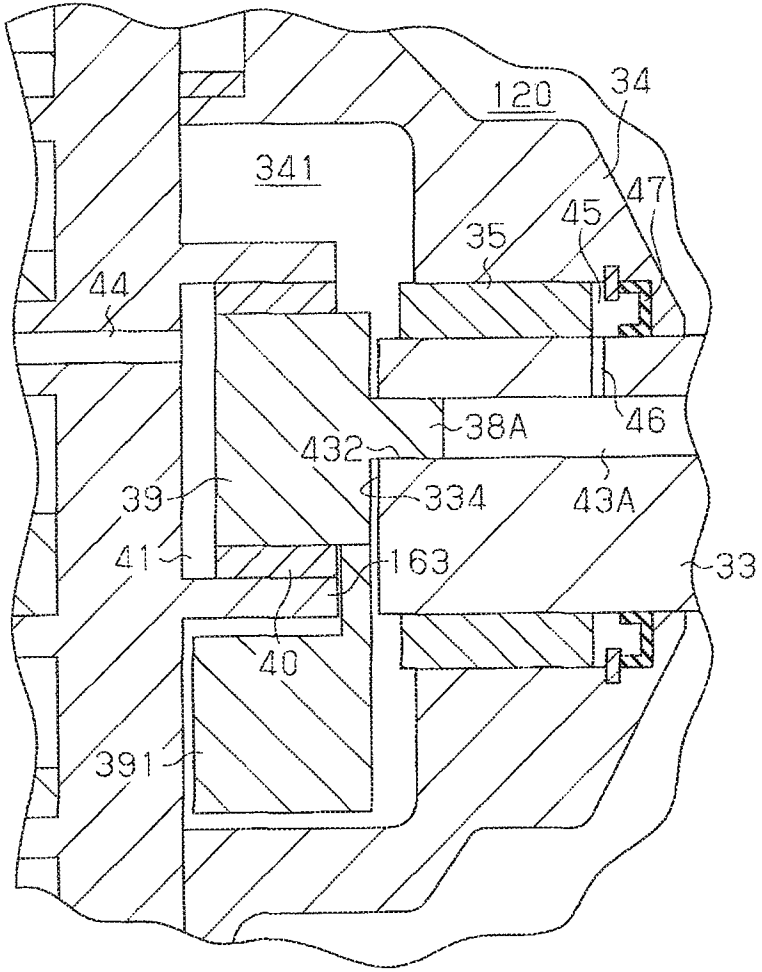
FIG. 5 is an enlarged cross-sectional side view partially showing a motor-driven compressor according to a third embodiment of the present invention.

A motor-driven compressor according to a third embodiment will now be described with reference to FIG. 5.

An eccentric shaft 38A is formed integrally with the bushing 39. An in-shaft passage 43A has an opening 432 in an end face 334 of the rotary shaft 33, and the eccentric shaft 38A is fitted into the in-shaft passage 43A via the opening 432, that is, engaged with the opening 432 to be fixed to the rotary shaft 33. That is, the in-shaft passage 43A, into which the eccentric shaft 38A is fitted, has the same functions as the in-shaft passage 43 of the first embodiment. The eccentric shaft 38A prevents lubricant oil from leaking through the opening 432 of the in-shaft passage 43A.

Figure 6:
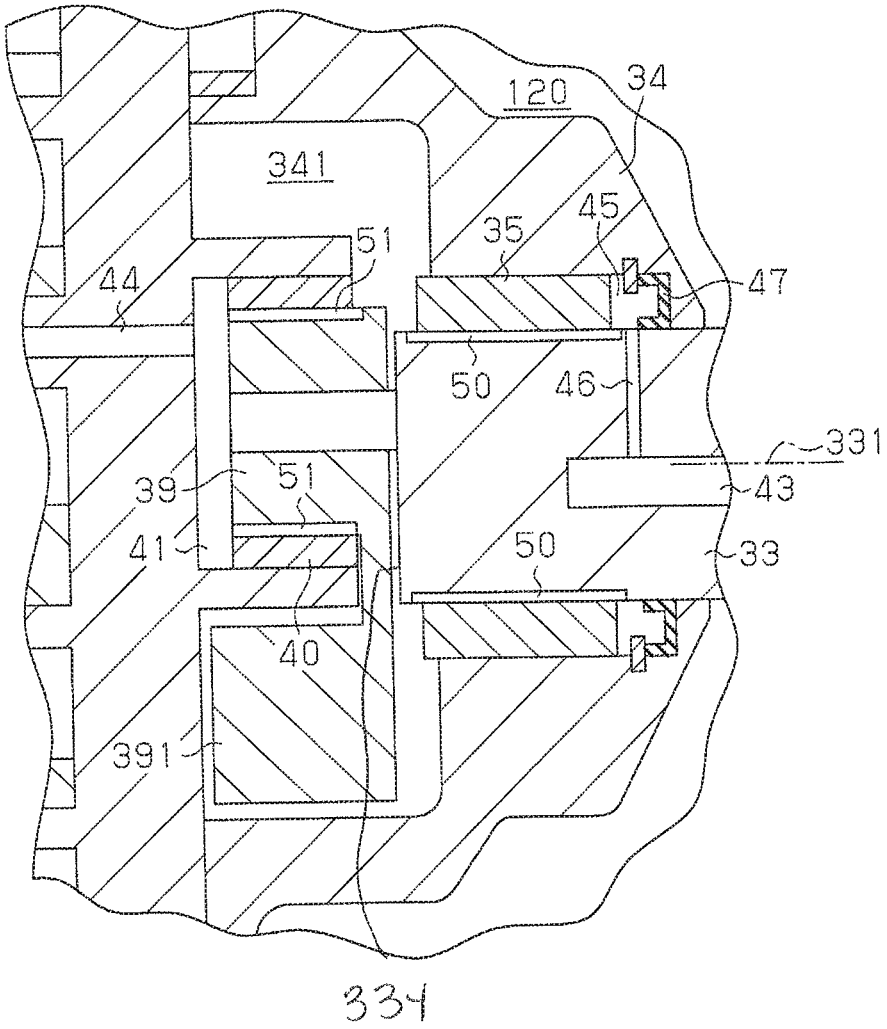
FIG. 6 is an enlarged cross-sectional side view partially showing a motor-driven according to a fourth embodiment of the present invention.

A motor-driven compressor according to a fourth embodiment will now be described with reference to FIG. 6.

Oil grooves 50 are formed in a part of the outer circumferential surface of the rotary shaft 33 that is surrounded by the main bearing 35. The oil grooves 50 extend parallel with the axis 331 of the rotary shaft 33. The oil grooves 50 connect the back pressure chamber 341 and the accommodation space 45 to each other. Also, oil grooves 51 are formed in a part of the circumferential surface of the bushing 39, and the oil grooves 51 extend parallel with the axis 331. The oil grooves 51 connect the clearance 41 and the back pressure chamber 341 to each other.

If the cross-sectional area of the oil passage 48 is large, it would be difficult to maintain the back pressure in the back pressure chamber 341 at a proper value. The oil grooves 50, 51 are suitable for regulating the degree of restriction of the oil passage between the back pressure chamber 341 and the in-shaft passage 43, that is, the cross-sectional area of the oil passage 48.

The present invention may be modified as follows.

Figure 7:
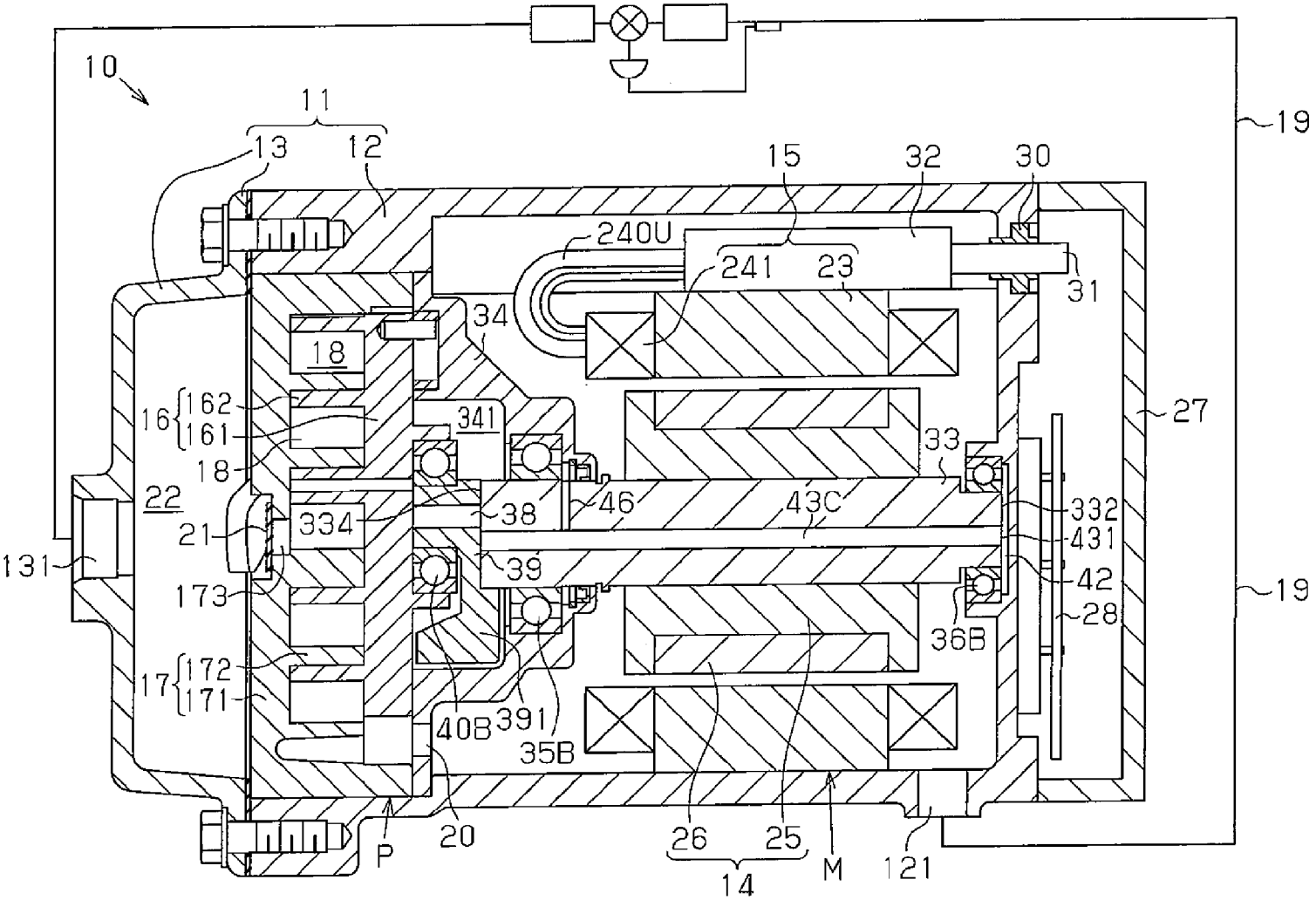
FIG. 7 is a cross-sectional side view showing a whole motor-driven compressor according to another embodiment of the present invention.

As shown in FIG. 7, a ball bearing may be used as a main bearing 35B.

As shown in FIG. 7, a ball bearing may be used as an auxiliary bearing 36B.

As shown in FIG. 7, a ball bearing may be used as an orbiting bearing 40B.

As shown in FIG. 7, an in-shaft passage 43C may extend from the rear end face 332 to the front end face 334 of the rotary shaft 33, and the bushing 39, which has a balance weight 391, may block the opening of the in-shaft passage 43C in the front end face 334. The bushing 39 prevents lubricant oil from leaking through the opening of the in-shaft passage 43C.

An oil passage that communicates with the discharge chamber 22 (a discharge pressure zone) may be formed to connect the discharge chamber 22 and the in-shaft passage to each other.

One or more oil grooves may be formed in a part of the outer circumferential surface of the rotary shaft 33 that is surrounded by the auxiliary bearing 36.

Only the main bearing may be a slide bearing, and the other bearings may be ball bearings.

Therefore, the present examples and embodiments are to be considered as illustrative and not restrictive and the invention is not to be limited to the details given herein, but may be modified within the scope and equivalence of the appended claims.

The invention claimed is:

1. A motor-driven compressor comprising:

a compression mechanism, which includes a stationary scroll, a movable scroll which orbits without being allowed to rotate, and a compression chamber located between the movable scroll and the stationary scroll, the volume of the compression chamber decreasing based on orbiting motion of the movable scroll;

an electric motor in a motor chamber, wherein the electric motor includes a rotary shaft and drives the movable scroll via the rotary shaft;

a main bearing located at an end of the rotary shaft which is closest to the compression mechanism, wherein the main bearing rotationally supports the rotary shaft;

a suction pressure zone;

a discharge chamber;

an axial passage formed in the rotary shaft so as to extend in an axial direction of the rotary shaft, the axial passage including one end located at a position closer to the compression mechanism than an opposite other end, an outlet of the axial passage located at the other end of the axial passage that is open to the motor chamber at a rear end face of the rotary shaft, and the one end of the axial passage not being open at a front end face of the rotary shaft in the axial direction, wherein the front end face of the rotary shaft faces the movable scroll;

an oil passage connected to the compression chamber, the oil passage including a radial passage formed in the rotary shaft as an inlet to the axial passage so as to be directly connected to the axial passage; and a stationary block fixed to the stationary scroll and rotationally supporting the rotary shaft via the main bearing, wherein the movable scroll is located between the stationary block and the stationary scroll to allow the movable scroll to orbit, the main bearing is accommodated in an accommodation space formed in the stationary block such that a gap is formed between the main bearing and the stationary block, the accommodation space is separated from the motor chamber by the stationary block, the accommodation space forms a part of the oil passage, and the radial passage opens to the gap, refrigerant that has passed through the main bearing flows into the axial passage via the radial passage, the main bearing is exposed to the oil passage, and the motor chamber is the suction pressure zone the rotary shaft includes an eccentric shaft located on the front end face of the rotary shaft that protrudes towards the movable scroll, and the movable scroll is supported by the eccentric shaft.

2. The motor-driven compressor according to claim 1, wherein the main bearing is a slide bearing.

3. The motor-driven compressor according to claim 1, wherein an auxiliary passage is formed in the stationary block at a position therein so as to branch from the oil passage and bypass the main bearing.

4. The motor-driven compressor according to claim 1, wherein the eccentric shaft is located between the movable scroll and the rotary shaft to cause the movable scroll to orbit.

5. The motor-driven compressor according to claim 1, wherein the eccentric shaft is located between the movable scroll and the rotary shaft to cause the movable scroll to orbit, and a bushing is located between the eccentric shaft and the movable scroll.

6. The motor-driven compressor according to claim 1, further comprising an auxiliary bearing located at another end of the rotary shaft in a position in the motor chamber that is opposite to the main bearing, wherein the rotary shaft is supported by the auxiliary bearing, and the auxiliary bearing is a slide bearing.

7. The motor-driven compressor according to claim 1, wherein a passage that is connected to the compression chamber is formed in the movable scroll, and the passage in the movable scroll forms a part of the oil passage.

* * * * *